United States Patent [19]

Weinlich

[11] Patent Number: 4,483,496

[45] Date of Patent: Nov. 20, 1984

[54] METHOD OF WINDING FILAMENTARY GOODS, IN PARTICULAR CABLES

[76] Inventor: Leopold Weinlich, Industriestrasse 6, D-6831 Reilingen, Fed. Rep. of Germany

[21] Appl. No.: 417,111

[22] PCT Filed: Jan. 13, 1982

[86] PCT No.: PCT/DE82/00008

§ 371 Date: Sep. 3, 1982

§ 102(e) Date: Sep. 3, 1982

[30] Foreign Application Priority Data

Jan. 15, 1981 [DE] Fed. Rep. of Germany ..... 3101126

[51] Int. Cl.[3] ..... B65H 54/28; B65H 75/18

[52] U.S. Cl. ..... 242/158 R; 242/117

[58] Field of Search ..... 242/158 R, 158.2, 158.3, 242/158.4 R, 25 R, 117, 54 R, 47

[56] References Cited

U.S. PATENT DOCUMENTS

| | | | |
|---|---|---|---|
| 1,456,108 | 5/1923 | Johannesen . | |
| 1,504,005 | 8/1924 | Vienneau . | |
| 1,865,236 | 6/1932 | Daniels . | |
| 2,732,150 | 1/1956 | Le Bus, Sr. | 242/117 |
| 3,272,454 | 9/1966 | Lane et al. . | |
| 3,610,549 | 10/1971 | Wennerstrom . | |
| 4,005,834 | 2/1977 | Landreau | 242/158.3 |

FOREIGN PATENT DOCUMENTS

| | | |
|---|---|---|
| 0017178 | 10/1980 | European Pat. Off. . |
| 1199403 | 8/1965 | Fed. Rep. of Germany . |
| 1574385 | 2/1967 | Fed. Rep. of Germany . |
| 1262717 | 3/1968 | Fed. Rep. of Germany . |
| 1295288 | 5/1969 | Fed. Rep. of Germany . |
| 1505831 | 12/1967 | France . |
| 2166565 | 8/1973 | France . |
| 112181 | 10/1974 | Japan . |
| 64680 | 5/1977 | Japan . |
| 505130 | 6/1939 | United Kingdom . |
| 819273 | 9/1959 | United Kingdom . |

*Primary Examiner*—Stanley N. Gilreath

*Attorney, Agent, or Firm*—Frishauf, Holtz, Goodman & Woodward

[57] ABSTRACT

To wind heavy filamentary materials such as cables, ropes, hawsers and the like on a drum or reel, without tangling of the material, the cables (for short) (6) are wound over a major portion of the drum in ring-shaped non-spiral form, with a transition zone (13) in sharply angled shape to move the cable laterally for the thickness thereof; the first winding loop of the first layer is spaced from the end flange (3) by half the cable width, for example by blocks (30) or spacer holders (31, 32); the last winding loop (17) fits tightly against the other end flange (4), the second layer (20) being formed by a rise over the first layer in the transition zone and placement of the second layer in the groove formed by the cylindrically wound cables of the first layer—and so on. The transition zones can be angularly offset (**13, 13*c*), parallel to the axis (5**) or skewed or spiraled, to preserve roundness of the outer circumference of the wound goods. Since the cable, in the ring-shaped portion, will fit in the groove of adjacent windings therebeneath, tangling is eliminated.

15 Claims, 8 Drawing Figures

METHOD OF WINDING FILAMENTARY GOODS, IN PARTICULAR CABLES

The invention relates to a method of winding filamentary goods, in particular cables, on a drum, or spool having a drumlike core and end flanges; the goods to be wound are placed in individual windings located adjacent one another in layers on the core.

BACKGROUND

Cables are wound onto the drums required for transporting them and storing them—known as cable drums—in windings located adjacent one another such that the core is first completely covered with windings by a first layer, and then a second layer is wound in a corresponding manner over the first, and so forth, until the drum is full or the required length of cable has been wound. For each layer, the attempt is made to cause the cable to assume the shape of a cylindrical spiral as much as possible, with the individual windings being wound closely adjacent to one another. To this end, the cable being brought to the coil is conventionally not directed toward it during winding at the same angle of inclination as in the cylindrical spiral; instead, it is fed at an angle which deviates therefrom for the sake of providing a bias so that the winding being formed will be pressed as closely as possible against the adjacent winding already in place on the core. Depending upon the type and the characteristics of the goods to be wound, it is more or less difficult to attain the desired form of a cylindrical spiral for the second, and subsequent layers as well, once the first layer has been wound. As a rule, an operator is required for monitoring and correcting the winding process in order to attain the desired cylindrical spiral pattern. The reason for these difficulties is that at the beginning and end of the first layer between the first and last windings, respectively, and adjacent the end flanges, wedge-shaped gaps are formed, and the goods to be wound, for instance the cable, of the second layer tends to drop into this wedge to a greater or lesser extent. The error caused thereby is repeated in all the subsequent layers and is added to the irregularities occurring at the transition from one layer to the next. The more layers are wound, the greater the difficulty in forming an orderly transition from one layer to the next. A further problem is that layers disposed above one another are each in the form of one cylindrical spiral, and the windings of the various spirals cross over one another. When winding the goods onto a layer which has already been completed, it is frequently unavoidable for a portion of the winding now being formed to come loose from the winding immediately adjacent it and to drop into a part of the groove-like depression between two adjacent windings of the layer beneath it. The cylindrical spiral pattern is then completely destroyed, and the further windings take a zig-zagging course. The gap formed in a layer as a result may cause disruptions in the layer or layers above it. Such disruptions or irregularities in forming the layers impair the winding process, however, and may even cause damage to the goods being wound under some circumstances. Furthermore, an irregular coil is the result, which is undesirable.

THE INVENTION

It is an object to provide a method which makes it possible to wind even goods which are difficult to wind, such as cables, on a drum in such a manner that the danger of irregularities in the coil makeup is reduced to a minimum, so that it no longer becomes necessary for one person to be solely assigned to monitoring and correcting the winding process on a continuous basis.

Briefly, the goods to be wound are so guided that, for the major part of the circumference of one winding, the center line of the winding follows an annular, endless curve encompassing the core upon which the goods are wound; the goods are then, for a predetermined transitional zone representing a smaller portion of the winding circumference, guided axially to the next adjacent essentially circularly circumferential winding of the same layer. The individual windings of the first layer begin with a first winding located, outside the transitional zone, with its center line spaced by approximately the diameter of the goods from the adjacent inner face of the adjacent end flange. The remaining windings are guided to be located over the length of the core at a small distance apart from one another. The guidance is so controlled that the last winding outside the transitional zone is located—at the minimum distance from the inner face of the second end flange.

The goods are then guided outward from the last winding of the first layer, within the transition zone and unto the second layer, where they are wound in corresponding windings; outside their transitional zone, these windings of the second layer each rest in groove-like depressions formed by adjacent windings of the first layer. Once this second layer is completed, the goods of further layers are guided from the last winding of one layer, within the transitional zone, into the next subsequent layer.

In this method, in contrast to the known method discussed above, the first winding of the first layer is not wound, beginning at the inner face of the end flange, as the initial portion of a cylindrical spiral. The initial part of the first winding is instead secured on the core, or brought out from the interior of the core, with its center line spaced apart by the diameter of the goods from the adjacent inner face of the end flange; or if the end of the goods is carried to the outside through the end flange, then it is brought into this spaced-apart disposition as soon as possible. Thus spaced apart from the inner flange of the end face, the circumferentially longest possible portion of the first winding is formed into a ring, the center line of the goods following a closed, annular curve. Within a segment or portion of the circumference of this curve, the goods are guided laterally to form the transitional zone, to the beginning of the second loop, which is then wound parallel to the first winding or loop in an annular circular pattern outside the transitional zone; the subsequent windings or loops are then formed in the same manner. In this process, the windings are not wound up on the core such that they rest closely against one another. The distance between the center lines of adjacent windings is instead selected such that although the interstice between the windings is as small as possible, still the condition is satisfied that the last winding being formed in the first layer is disposed at the least possible distance from the adjacent end flange inner face toward which the layer approaches as it is being formed. The location at which the goods are lifted or raised into the second layer is thus predetermined with sufficient accuracy.

The first layer forms a satisfactory base for the further layers to be formed upon it, having such characteristics that disruptions in the makeup of these further layers are substantially precluded. Each of the windings of the second layer is guided laterally by the groove-like depressions defined between each two adjacent windings of the first layer, thus satisfactorily locating the windings in position. The same is true for all the further layers formed on the core.

The annularly closed curves along which the goods of each winding are disposed over the major portion of the circumference of each winding are advantageously disposed in parallel planes, which extend in turn parallel to the inner face of at least one end flange. In the case of a cylindrical core on which the goods are to be wound, these curves are circles, so that the individual windings, outside the transitional zone, each form circular rings. In cases where the end flange inner faces do not extend perpendicular to the axis of rotation of the coil or if they have other irregularities, such as deformations, it is possible to proceed such that outside the transitional zone, the ratio of the distances from the two end flange inner faces is constant along the curve, for each of the annularly closed curves.

Deviating from the above, it is possible to provide that in the individual layers, in the vicinity of the two end faces, at least one winding at each end extends at a constant distance, outside the transitional zone, between its center line and the associated end flange inner face; for the windings disposed between these end windings, however, the ratio of the distances between the center lines of the windings, extending at a constant distance from the end flange inner faces, is constant outside the transitional zone.

As already mentioned, the windings of the first layer are placed on the core in such a manner that they are not pressed closely against one another. The distance between the center lines of adjacent windings of the first layer is in each case equal to or greater than the maximum outer diameter to be expected within the tolerance range, or as actually measured, of the goods to be wound.

The transitional zones for the individual windings are disposed at precisely predeterminable locations. In a simple form of embodiment, the arrangement may be selected such that the transitional zones in one layer are defined by two straight lines which are axially parallel with the longitudinal axis of the coil. However, an arrangement is also conceivable in which the transitional zones in one layer are defined by two helical lines. In order to prevent the finished coil from being out of round after winding, the transitional zones of adjacent layers may be angularly offset from one another.

Various ways may be used to facilitate placing the first winding of the first layer at the distance of one diameter between the center line and the inner face of the flange. For instance, prior to beginning the winding process, a holder device can be disposed on the coil in the vicinity of the initial part of the first winding of the first layer, this holder device determining the distance between the winding and the adjacent inner face of the end flange and being embodied by way of example in the form of a block. This holder device may also be embodied by a spindle, a wedge or an adjustable jaw. Blocks which can be secured from outside or inside with the aid of a quick-fastening means are also conceivable. The adjustability of the block, or the rapidity with which it can be exchanged for another, should make it easier to adapt to goods of different diameters. If the initial part of the goods to be wound is threaded through an opening in the core, then a centering device disposed in the opening, and possibly adjustable, may serve the same purpose. It is also possible for a tensioning device which is displaceable in the longitudinal direction of the coil to be used for fastening the initial part of the goods to be wound on the jacket of the core upon which they will be wound.

Finally, a support element can be disposed on the core in the vicinity of the first winding of the first layer, at least partially filling the interstice between the first winding and the adjacent end flange inner face. This support element may be embodied as axially and/or radially adjustable in order to enable adaptability to various diameters on the part of the goods to be wound. It is also conceivable for at least the first winding of the first layer and the last winding of the second layer to be wound such that they have different tensions. Because the tension of the windings of the second layer, which are of interest here, is selected to be smaller, the first winding of the first layer is prevented from being pressed toward the inner face of the adjacent end flange, which could cause an irregularity in the makeup of the coil winding.

In the novel method, the first layer wound onto the winding core reinforces the formation of the second layer, which is effected by the same principle, as already noted. This effect continues through all the layers on the coil. Fluctuations in the outer dimensions of the goods to be wound in the direction of the longitudinal axis of the core cannot affect the formation of the coil winding in any manner. The transition from one layer of goods to the next is furthermore predetermined precisely, so that it is no longer necessary to monitor the rise of the goods into the next subsequent layer separately during the winding process and to correct it as needed. The danger that the goods will be raised unintentionally into the next layer, which is also called "creeping", is reduced to a minimum, because the goods do not have to be wound with relatively great initial tension, as is otherwise conventional and necessary in order to prevent the creation of uncontrollable gaps between the windings.

DRAWINGS

Shown are:

FIG 1, a cable drum having a first layer of cable wound partially onto it, seen in plan view illustrating the annular portion of the windings;

FIG. 2, the cable drum of FIG. 1, rotated by 180°, illustrating the transitional zone of the last and next-to-last winding, in a view corresponding to FIG. 1;

FIG. 3, the cable drum of FIG. 2, showing the transitional zone of the last and next-to-last layer, in a corresponding view;

FIG. 4, a developed view of the first layer of the cable drum of FIG. 1;

FIG. 5, a developed view of the first two layers of the cable drum of FIG. 1;

FIG. 6, the developed view of FIG. 5, sectioned along the line VI—VI of FIG. 5, seen in a side view and shown schematically;

FIG. 7, a developed view of the first layer of a cable drum having an irregular right-hand end flange; and FIG. 8, a developed view of the first layer of a cable drum having an irregular right-hand end flange, this layer having been wound in a modified form of embodiment.

DETAILED DESCRIPTION

Figure 1:
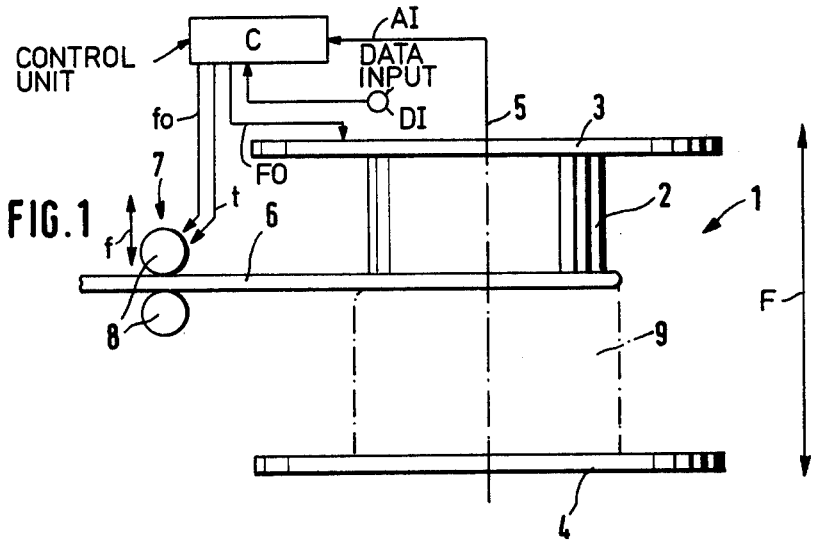

In the embodiments shown in the drawing, the winding method is illustrated in terms of the winding of a cable on a cable drum, which represents the coil body. In principle, the method is inherently applicable to the winding of various filamentary goods to be wound, such as ropes, wires, thread and the like.

Figure 2:
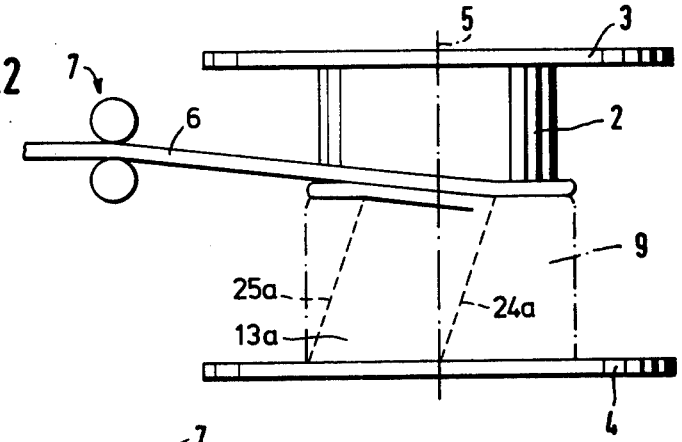
Figure 3:
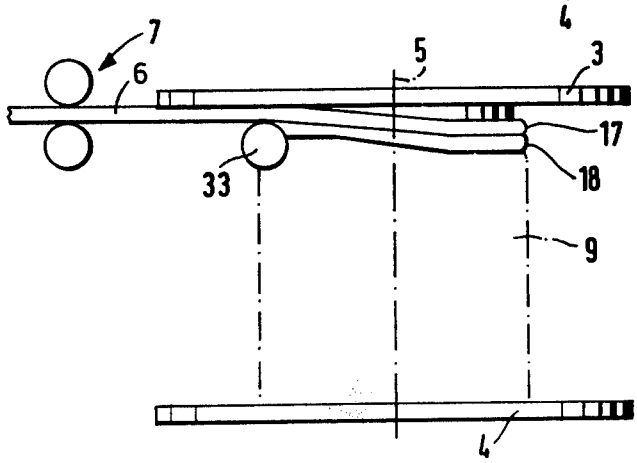

The cable drum 1 shown as a coil body in FIGS. 1-3 has a drum-like cylindrical core 2, on which two circular end flanges 3, 4 are mounted at the ends in a known manner. The arrangement is selected such that the inner faces of the end flanges are located in parallel planes, which extend at right angles to the longitudinal or rotational axis of the drum shown at 5. The deviations of the end flange inner faces from this perpendicular disposition are small in proportion to the diameter of the cable 6 to be wound and which in this case represents the goods to be wound.

While the cable 6 is being wound, the cable drum 1 is driven by drive means known per se (not shown), so that it rotates about its longitudinal or rotational axis 5; the cable 6 is fed to its core 2 via a guide system 7, which comprises two guide rollers 8, which are supported in appropriate bearing parts (not shown) of the guide system. During the winding process, a relative movement in the direction of axis 5 is generated between the guide system 7 and the cable drum 1, which is controlled in such a manner that the individual windings of the cable 6 are disposed in a predetermined manner adjacent to one another on the core 2 or on the particular layer located beneath them, as will be described in greater detail below.

Figure 4:
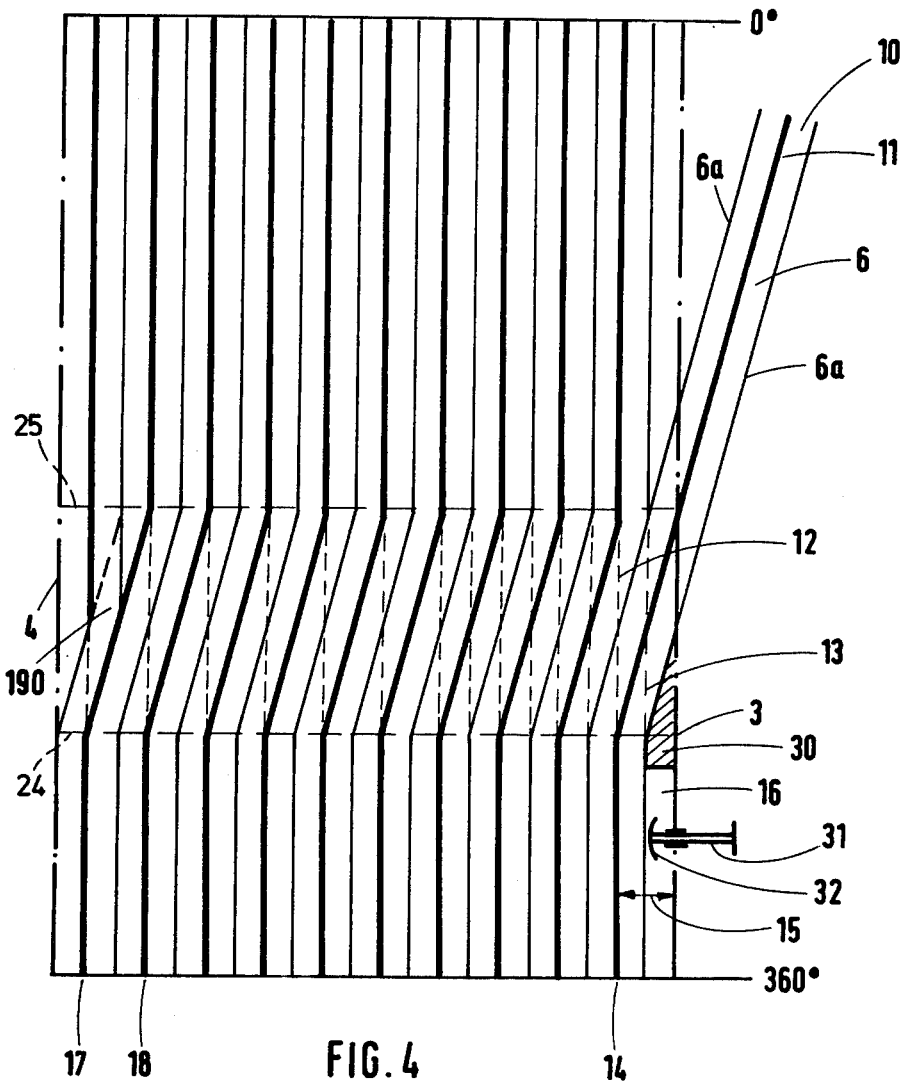

The winding process begins with the placement of the first layer 9 on the core 2, which is illustrated in FIGS. 1-3. The cable 6 is wound in such a manner that the developed view of FIG. 4 is produced; the winding process for the first layer can be explained with reference to this view, as follows:

WINDING THE FIRST LAYER

The initial portion 10 of the cable 6 is threaded through an opening in the core 2, or in the right-hand end flange shown schematically at 3 with its inner face shown by dot-dash lines, into the interior of the coil drum 1. The cable 6 is represented by its center line 11, which is a heavy, solid line in the drawing, and the two thin lines 6a which indicate its outlines or outer limits. By appropriate control of the relative movement between the guide system 7 and the cable drum 1, the individual windings are wound with their center lines 11, for the major part of their circumference, following respective circular-annular, endless curves 12 encompassing the core 2. In a precisely predetermined zone, that is, the transition zone shown at 13, the cable 6 is guided from one winding loop into the adjacent winding position, or loop. The first loop or winding position 14 of the first layer 9 extends with its center line 11 at a distance 15 from the associated end flange inner face 3, which is approximately equal to the diameter of the cable 6; this means that a free space 16 is produced between the end flange inner face 3 and the first winding outside the transitional zone 13, the width of this space being equal to approximately half the diameter of the cable. The closed, circular-annular curves 12, which are followed by the individual windings outside the transitional zone 13, are located in parallel planes, which extend spaced apart from one another and at right angles to the longitudinal or rotational axis 5 of the drum and are directed parallel to the end flange inner faces 3, 4. The individual windings are not pressed closely against one another; rather the distance between the center lines 11 of adjacent windings is instead selected to be such that, leaving the smallest possible interstice between adjacent windings, it is still larger than the largest outer dimension of the cable to be expected within the tolerance range or actually measured. The distance between the center lines 11 of adjacent windings is furthermore controlled over the axial length of the first layer 9 such that the last winding 17 is at the smallest possible distance from the inner face of the end flange 4 toward which the layer 9 approaches as it is being wound.

TRANSITION BETWEEN LAYERS

Figure 5:
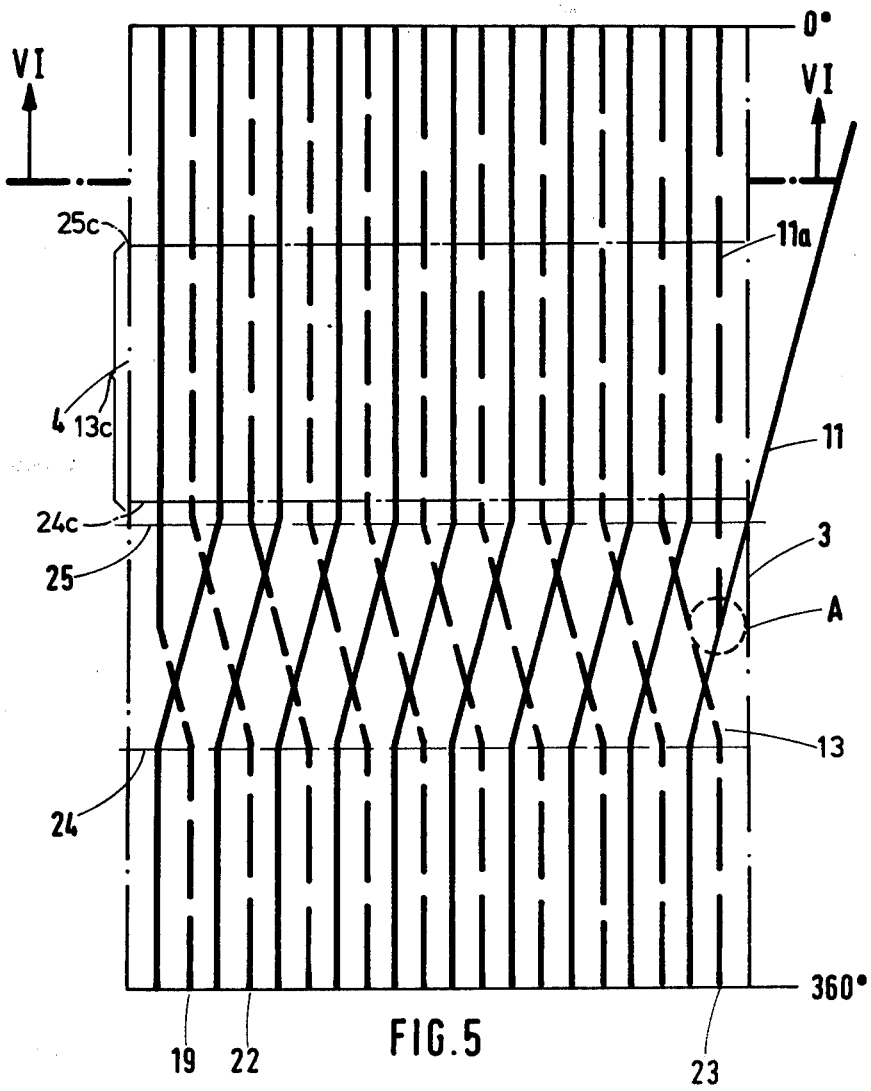

At the end of the last winding 17 of the first layer 9, the interstice between the end flange inner face 4 and the transition of the cable from the next-to-last winding 18 narrows at 190 in wedge-like fashion within the transitional zone 13. The location at which this takes place is predetermined with sufficient accuracy for controlling the guide system 8 by means of the location of the transitional zones 13. Over approximately the first half of the transitional zone 13, the cable 6 is still guided on the plane of its annular segment, so that it does not yet vary its position in the axial direction. Approximately in the middle of the transitional zone, then, the transition into the annular segment of the first winding 19 (see FIG. 6) of the second layer 20 begins; this is indicated in FIG. 5 with the center lines 11a of the windings of the second layer 20 being represented as dashed lines. In FIG. 5, only the center lines 11 of the cable are shown for clarity; the outer dimension lines 6a have been omitted.

Figure 6:
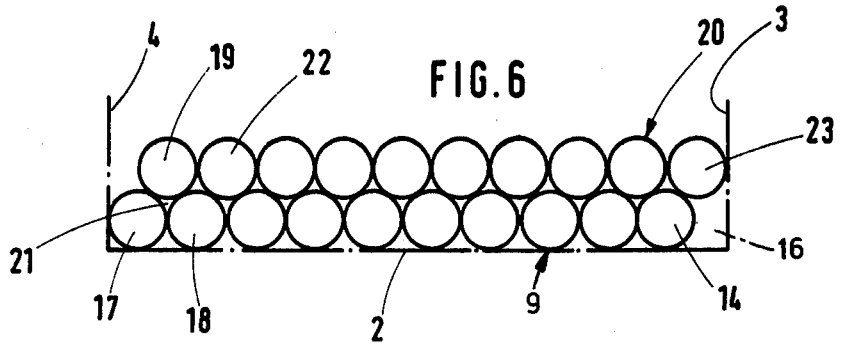

As may be seen from FIG. 6, the first winding 19 of the second layer 20 is offset relative to the last winding 17 of the first layer 9 by half the spacing between windings; this means that outside the transitional zone, that is, for the major part of its circumference in which its center line again traces a circular-annular curve 12, this first winding 19 of the second layer 20 places itself into the groove-like depression 21, which is defined by the circumferential surface of the last and next-to-last windings 17 and 18, respectively, of the first layer 9.

Approximately at the beginning of the transitional zone 13 of the first layer 9, the cable is guided out of the annular segment of the first winding 19 in a transitional zone into the annular segment of the second winding 22 of the second layer 20, in the same manner as with the first layer 9, whereupon the second layer is wound further in corresponding fashion. Since the spacing between windings is the same as in the first layer, all the windings of the second layer 20—except for the last winding 23—come to rest within the groove-like depressions 21, which are on the surface of the first layer 9. The last winding 23 is supported within the annular segment, outside the transitional zone 13, by the inner face 3 of the end flange on one side and by the first winding 14 of the first layer 9 on the other, as may be seen particularly from FIG. 6.

SUBSEQUENT MULTI-LAYER WINDING

Inside the transitional zone 13, as in the vicinity of the last winding 17 of the first layer 9, the cable 6 is guided out of the last winding 23 of the second layer 20 into the first winding loop, no longer shown in the drawing, of the next subsequent layer. This is clearly shown in FIG. 5, where at point A the dashed line indicating the center line 11*a* of the last winding 23 of the second layer 20 merges with the solid line 11, which from this point indicates not only the center line of the cable in the first layer 9, but also the third, fifth, and seventh layers, and so forth. The dashed line 11*a* correspondingly indicates the center line of the cable windings in the second, fourth, and sixth layers, and so forth.

In FIG. 5, the transitional zones 13 of the two layers 9, 20 are located one over the other at the circumference of the coil winding, for the sake of simplicity; they are defined by two straight, axially parallel lines 24, 25. As a rule, the transitional zones 13 of the individual layers are not, however, placed directly above one another but rather are offset at an angle from one another, so as to avoid a coil which is greatly out of round. The spacing of the transition zones 13, of superposed layers, is somewhat greater than the lengths of the zones in the vicinity of the annular segments of the windings. By means of the angular offset between respective transitional zones 13, addition of out-of-roundness errors from one layer to the next are avoided.

The angular offset is not schematically shown in FIG. 5 for a third layer. As can readily be seen from FIG. 5, the broken lines and the limit lines 24, 25 can be shifted axially to positions 24*c*, 25*c* which is a movement up (in FIG. 5) or down on the developed view, for example by approximately the distance of the zone 13, for example slightly more, if the overall circumference of the drum permits to shift the transition zone to position 13*c*.

It is also possible, and deviating from the illustration of FIGS. 4 and 5, to skew the location of the transition zones 13, that is, to define the transition zone not by two lines 24, 25 which are parallel to the axis of the coil, but rather shifted to (FIG. 2) 13*a*, to form the limits by two spirals 24*a*, 25*a* which, in FIG. 5, would appear as two parallel lines having an acute angle with respect to the axis 5.

The method described with reference to FIGS. 4–6 presumes that any deviations in the inner faces 3, 4 of the drum flanges from planes extending at right angles to the longitudinal or rotational axis 5 of the drum are slight in proportion to the cable diameter. If this condition no longer pertains, then the winding of the cable 6 can be effected in the manner shown in FIG. 7 or FIG. 8:

Let it be assumed that the inner face of the right hand end flange 3' extends in the manner shown in dot-dash lines in the developed view, while the inner face of the left-hand end flange 4 is located, as before in a plane extending at right angles to the longitudinal or rotational axis 5. The individual windings of the first layer illustrated are represented in the drawing only by the central line 11 of the cable 6.

Figure 7:
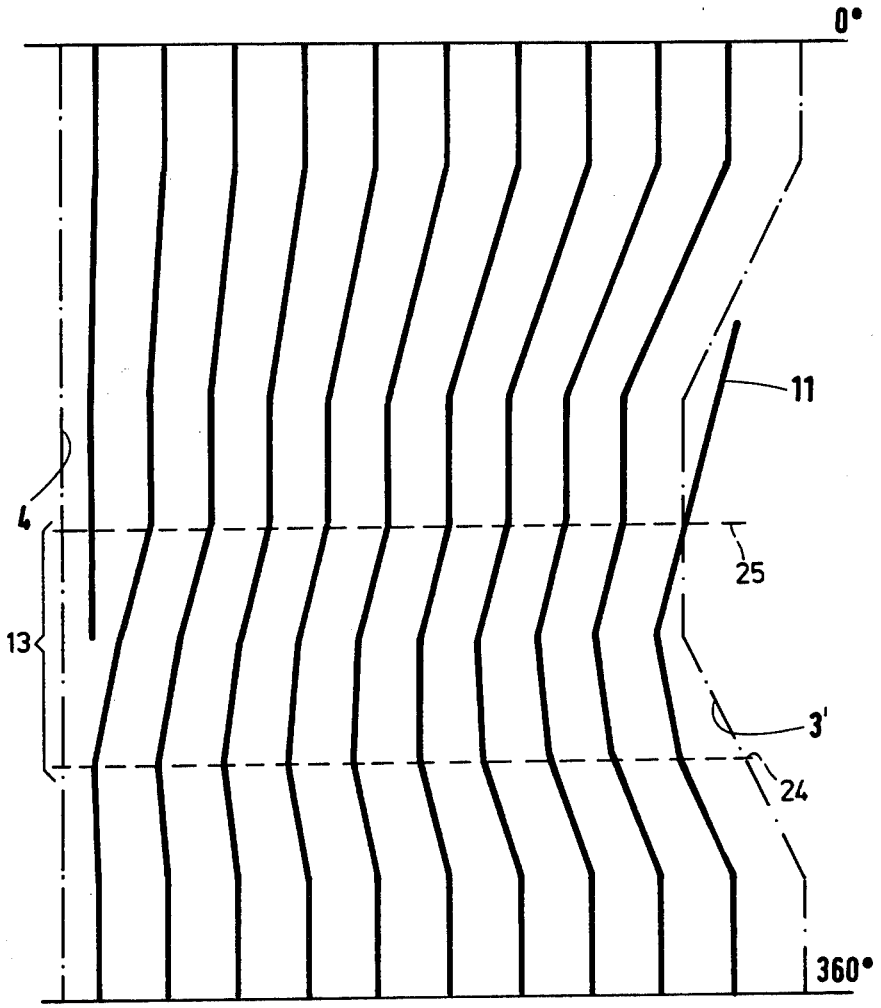

In the form of embodiment shown in FIG. 7, the windings are placed onto the core 2 in such a manner that outside the transition zone 13, the ratio of the distances between the center line and the end flange inner faces 3, 4 is constant for each winding.

Figure 8:
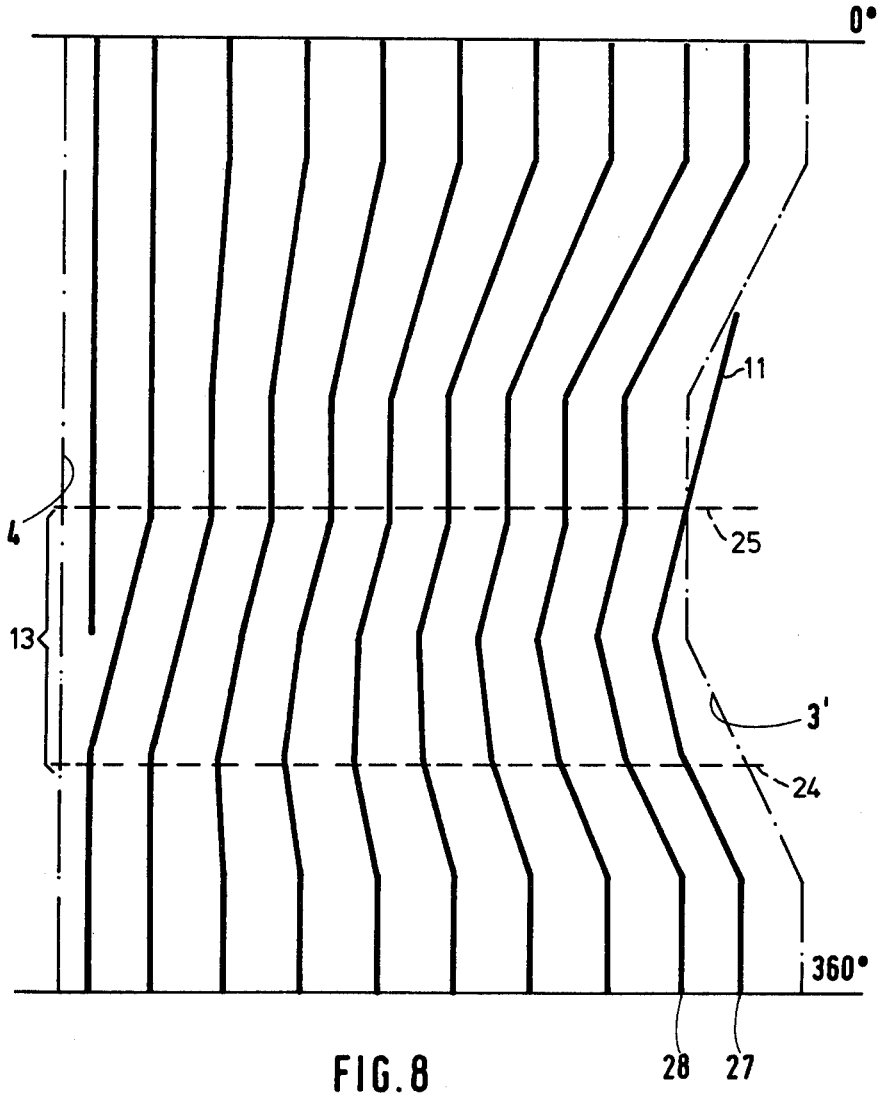

In the form of embodiment shown in FIG. 8, the arrangement is such that a certain number of the windings of the first layer located nearest the two end flange inner faces 3', 4—in the present case, the two windings 27, 28—are wound, outside the transition zone 13, with a spacing between their center line 11 and the associated end flange inner face 3' or 4 which is constant but as small as possible, or in other words following this inner face; meanwhile, the windings located in between are wound in such a manner that outside the transition zone 13, the ratio of the distances between their center lines 11 and the center lines 11 of the windings which extend at a constant distance from the end flange inner faces 3', 4 is constant.

In order to make it easier to begin the first winding 14 of the first layer 9 (FIG. 4) with its center line 11 spaced apart from the end flange inner face 3 by the distance 15 corresponding to the cable diameter, various provisions may be made:

If the initial portion 10 of the cable is inserted through an opening in the end flange 3, a block 30 which presets the distance 15 can be secured on the core 2 or on the end flange 3. Instead of one block 30, a plurality of blocks may also be distributed along the circumference within the space 16. It is also conceivable to provide a spindle 31 threaded through the end flange 3 from the outside of the end flange, the spindle having a jaw 32 which is axially adjustable, so as to make it easy to adapt to various cable diameters. The block or blocks 30 may also be provided with quick-change devices to make it possible to replace them quickly.

If the initial portion 10 of the cable is threaded through the core 2 into the interior of the drum 1, then a centering device can be used, which is mounted in the opening through which the cable passes and which may be adjustable. Finally, it is also possible to use a tensioning device which is displaceable in the axial direction of the drum for fastening the initial portion of the cable to the jacket face of the core 2; this is not shown in further detail.

When the next-to-last winding of the second layer 20 (FIG. 6) is put into place, the danger may arise that if the winding tension is high, the first winding 14 of the lower layer 9 will be pressed toward the right, that is, toward the end flange inner face 3 and be deflected. In order to prevent this from happening, it may be efficacious to fill the interstice 16 between the first winding 14 and the inner face of the end flange 3 with blocks 30 or an annular-segmental element. The blocks 30 or the annular-segment element may, in turn, be axially adjustable. If cables 6 having very different diameters are to be wound up on a cable drum, then the radial height of the blocks 30 or of the annular-segment element may be made larger over the core 2 as the distance from the end flange inner face 3 increases, since in the case of thinner cables 6 this height must remain substantially less than the cable diameter, yet with thicker cables 6 it must not be less than half the cable diameter. This can be attained by placing the blocks 30 on steeply inclined planes or by placing the annular-segment element on a conical face.

A uniform axial adjustment of the annular-segment element can be made compulsory by distributing helical segments over the circumference. In that case, the annular-segment element is rotated on the core 2 in order to adjust it in the axial direction.

In order to wind the windings in the manner explained above, a relative movement must be generated between the guide system 7, 8 and the cable drum 1 in the axial direction of the drum, which is dependent on the drum rotation. This movement is composed of both a step, or an incremental movement in any layer, always in the same direction, which corresponds to the distance between loops of the windings symbolized by arrow F, and a more rapid, reciprocating movement of short strokes symbolized by arrow f, for generating the transitional zone 13 from one winding loop to the next (see FIG. 2). If needed an additional movement for compensating for cable drum errors in the vicinity of the end flanges 3, 4, as has been explained with reference to FIGS. 7, 8 may be needed.

In principle, the relative movement between the guide system 7 and the cable drum 1 can be generated by axially displacing the cable drum 1 (FIG. 1, arrow f) or the guide system 7. If the guide system 7 is not to be moved out of the center line of the cable feeding device disposed preceding it, then it is more efficacious to displace the cable drum. However, the greater the winding speed, the more rapidly the cable drum 1 and the guide system 7 must be moved relative to one another, and thus the greater the forces of mass generated by unequal movements. Thus when the winding speed is high, the procedure is performed as follows:

The cable drum 1, which becomes heavier and heavier as winding proceeds, is as a rule moved axially in increments or approximately uniformly in accordance with the progression of the newly formed winding loops. The guide system 7 executes merely the required rapid reciprocating movements for generating the transitional zone 13 and, as needed, for compensating for any imprecision in the inner faces of the end flange. These movements are executed about the center line of the preceding cable feeding device.

The described movements are controlled by a control unit, or device C which is supplied with data at a data input DI representing at least the distance between the inner faces of the end flanges 3, 4 and the largest diameter of the cable 6 to be expected or as measured in the axial direction of the cable drum. In order to control movement of the guide system and/or the drum, the control device C receives data continuously, at least relating to the rotational angle executed by the cable drum, beginning with the angular position of the initial portion of the first winding 14 of the first layer 9 as schematically shown by input AI.

The control device C calculates the least possible winding loop distance, which is ascertained from the two conditions: (1) the center line 11 of the first winding is at the distance of the cable diameter from the end flange inner face 3 adjacent to it; (2) the last winding 17 of the first layer 9 is at a minimum distance from or rests on the inner face of the end flange 4, adjacent to it (see FIG. 6). In making this calculation, the increase in cable width in the axial direction of the drum in the transition zone from one winding to the next subsequent winding must, as a rule, be taken into consideration.

With the result of this calculation, together with the cable width and other fixed, given parameters, such as certain physical properties or dimensions of the cable, the control device calculates the length of the transition zone 13 in the circumferential direction as well as all the variables derived therefrom to control the relative movement between the cable drum 1 and the guide system 7, which is dependent on the cable drum rotation with respect to winding spacing, and transition zone length, and location, as schematically shown by outputs FO and fo, respectively.

As an important datum for this control function, the diameter of the core 2 is fed to the control device C, in order to determine the placement and the length of the transition zone 13 of the individual windings for the first layer 9 in the form of a corresponding angular range. For the upper layers of windings, the control device C can calculate the diameter of a layer and correct it, with the aid, as needed, of measurements, for instance of the linear cable speed and the rotary speed of the cable drum.

Finally, the data fed to the control device C may include data relating to the deviations of the end flanges 3, 4 from planes perpendicular to the longitudinal or rotational axis 5; these data are then used in the movement control for attaining the course of winding described with respect to FIGS. 7, 8.

As may be seen from FIGS. 1, 2, the winding of the first layer presents no difficulties, so long as the cable 6 being delivered for winding is not hindered by the end flange 3 toward which the layer approaches as it is formed. As may be seen in FIG. 3, however, because of the end flange 3 the cable 6 cannot be guided at the angle required for forming the transition zone 13, at least in the transition zone 13 from the next-to-last winding 18 to the last winding 17, and possibly even in transition zones several winding loops preceding the next-to-last winding. However, the placement of these, and the last winding 17, 18 is nevertheless easily accomplished in practice, because previously placed winding loops immediately preceding the last few, or last winding loops will themselves assist in the formation of the transitional zone 13.

Under particularly unfavorable circumstances, particularly when the cable surfaces have very high coefficients of friction among themselves, the danger exists that the cable may rise from one into the next layer too early. In order to avoid this, it may be necessary to utilize an additional support device as the cable approaches toward an end flange; this support device is indicated in FIG. 3 and is embodied there, by way of example, in the form of a roller 33 which guides the cable 6. The cable can also be guided radially with respect to the drum. The tension with which the cable 16 is wound is controllable so that the winding tension of the first loop or first layer 9 and the last loop of the second layer are different, as schematically shown by tension control line t from control unit C.

I claim:

1. Method of winding cable goods or the like (6) on a drum (1) having a cylindrical core (2) and end flanges (3, 4) at least generally located at right angles to the axis (5) of the core, in which the goods are wound on the core between the flanges comprising, in accordance with the invention, the steps of (a) guiding and winding the goods in an essentially circular, non-spiral ring-shaped path about the core (2) over a major portion of the circumference of the core, in which the center line (11) of the goods follows an endless ring-shaped curve and spacing the center line of the first winding loop from the inner wall of the first adjacent flange of the drum by about the thickness of the goods, whereby a lateral end surface of the goods will be spaced from said inner wall by about half the diameter of the goods;

(b) guiding, and winding the goods, within the remainder of the circumference, and forming a minor portion thereof and a transition zone (13), in an axially shifting spiral path to provide an axial shift zone of the goods on the core, to an adjacent, essentially circular path;

(c) then continuing to guide, and wind, alternately, sequentially circular path portions defining closely adjacent non-spiral portions and spiral transition portions (13) until the essentially circular portion comes to lie adjacent the inner wall of the other one of the end flanges:

(d) winding and guiding the goods in said transition zone up and over the underlying layer to thereby form an upper layer (20);

(e) winding and guiding the goods in the upper layer so that the goods fit into the grooves formed between the center lines (11) thereof of the underlying first layer (9); and (f) repeating the steps (a), (b), (c), (d), (e), and wherein the steps (a), (b) and (c) comprise guiding said windings to maintain distances between the center lines (11) of adjacent winding loops such that adjacent loops of windings on the spool are loosely spaced from each other, and the last winding loop (17) is at a minimum loose spacing from the inner face of the adjacent other end flange;

the step (b) of guiding the goods within said transition zone (13) further comprises relatively moving the rotating drum (1) and the goods (6) with respect to each other in a rapid, reciprocating short-stroke movement in axial direction in relation to the drum;

(g) continuously determining, during the winding process, the necessary distance between the individual windings of the first layer (9), said calculation being based on:

the diameter of the goods (6) to be wound, the distance between the inner faces of the end flanges, the rotational angle position of the drum at a given instant of time; and (h) controlling the guidance of the goods in the steps (a), (b), and (c) in accordance with the so-obtained determination.

2. Method according to claim 1, wherein said ring-shaped closely adjacent, essentially circular, non-spiral portions of the goods wound on the core are placed in parallel planes, generally located at right angles to the axis (5) of the core.

3. Method according to claim 1, wherein said ring-shaped, closely adjacent, essentially circular, non-spiral portions of the goods wound on the core are placed in parallel planes which are, themselves, parallel to the inner surface of at least one of the end flanges (3, 4).

4. Method according to claim 1, wherein the relationship of the distances of the center lines (11) of the loops of the major portions of the windings outside of the transition zone from the inner surfaces of the end flanges (3, 4) is constant.

5. Method according to claim 1, wherein, in the first layer (9) on the core, at least one winding within said major portion and ouside of the transition zone has the same distance of its center line throughout the winding from the inner surfaces of the end flanges;

and wherein the center lines (11) of windings between said at least one winding and the inner surfaces of the end flanges, outside of the transition zones, have a relationship such that the distances of the center lines with respect to the center line of said at least one winding is constant or uniform.

6. Method according to claim 1, wherein the distance of the center lines of adjacent windings of the first layer (9) is at least equal to the widest outer diameter of the goods wound on the drum (1), or the widest expected outer diameter based on tolerance limits of said goods.

7. Method according to claim 1, wherein the transition zones (**13, 13*c*) of any layer are limited by theoretical lines (24, 25; 24*c*, 25*c*) parallel to the axis (5**) of the drum.

8. Method according to claim 1, wherein the transition zones (**13*a*) of adjacent windings in any one layer extend spirally about the axis (5) and the theoretical boundary lines (24*a*, 25*a*) spirally about said drum (1**).

9. Method according to claim 1, wherein the transition zones (**13, 13*c***) of adjacent, superimposed layers are angularly offset with respect to each other.

10. Method according to claim 1, wherein said step of spacing said first winding loop comprises spacing said first winding loop by a support element (30, 31, 32).

11. Method according to claim 10, wherein said supporting step comprises spacing the first winding by a support element which is adjustable in at least one of: axial direction; radial direction.

12. Method according to claim 1, further including the step of additionally guiding the goods by a guide element (33) located immediately adjacent the drum. and engaging the goods to guide the cable radially with respect to the drum.

13. Method according to claim 12, wherein said additional guiding step comprises guiding at least the last winding loop (17) of the first layer (9) being wound on the drum.

14. Method according to claim 1, further including the step of controlling the tension (t) of the goods being supplied to the drum as they are wound on the drum.

15. Method according to claim 14, wherein said tension controlling step further comprises changing the tension of the goods being supplied to the drum as the number of layers of goods on the drum increases.

* * * * *